United States Patent [19]

Schmitt

[11] 4,247,096

[45] Jan. 27, 1981

[54] PORTABLE SWIMMER TRAINING APPARATUS

[76] Inventor: Larry Schmitt, 2635 S. 152nd Cir., Omaha, Nebr. 68144

[21] Appl. No.: 44,461

[22] Filed: Jun. 1, 1979

[51] Int. Cl.[3] ..... A63B 69/14

[52] U.S. Cl. ..... 272/71; 272/142; 272/143

[58] Field of Search ..... 272/71, 26, 1 B, 119, 272/143; 35/29 B; 73/379, 380, 381; 248/291, 294, 288 R, 274, 207, 494, 495, 496, 353; 211/203; 52/73, 38; 182/3, 55, 82; 273/DIG. 19; 9/310 J

[56] References Cited

U.S. PATENT DOCUMENTS

| | | | |
|---|---|---|---|
| 95,321 | 9/1869 | Carrigan | 182/3 X |
| 1,897,810 | 2/1933 | Mallory et al. | 182/3 X |
| 2,176,772 | 10/1939 | Smith et al. | 182/82 X |
| 2,825,224 | 3/1958 | Lindenauer et al. | 35/29 B UX |
| 3,081,057 | 3/1963 | Farnsworth | 248/494 X |
| 3,259,349 | 7/1966 | Lee | 248/274 X |
| 3,363,777 | 1/1968 | Cooper | 248/207 X |
| 3,751,031 | 8/1973 | Yamauchi | 272/119 |
| 4,085,874 | 4/1978 | Graber | 248/291 X |

FOREIGN PATENT DOCUMENTS

| | | | |
|---|---|---|---|
| 2303694 | 8/1974 | Fed. Rep. of Germany | 272/71 |
| 1348994 | 12/1963 | France | 182/55 |
| 131992 | 8/1978 | German Democratic Rep. | 272/71 |

*Primary Examiner*—Richard C. Pinkham
*Assistant Examiner*—Arnold W. Kramer
*Attorney, Agent, or Firm*—Crisman & Moore

[57] ABSTRACT

A swimmer training apparatus for securement substantially within the side walls of a swimming tank. The apparatus comprises a collapsable support frame including at least one upstanding support arm having a lower side wall engaging element and an upper lateral restraint means for pivotal coupling with either the side wall lip, the outside of the deck, or the rope junction receptacle of the swimming tank side wall. Extending from the tank side wall towards the middle of the swimming tank, the support frame is attached to the swimmer by means of a flexible tether connected to a detachable, load distributing harness which is disposed about the waist of the swimmer. Such a portable swimmer training apparatus provides the swimmer with a commodius means of shock-dampened restraint confining the swimmer to a particular area of the pool while allowing him lateral maneuverability for the practice of various swimming strokes. The apparatus is advantageously constructed so as to permit attachment to the pool without modification thereto.

1 Claim, 10 Drawing Figures

PORTABLE SWIMMER TRAINING APPARATUS

BACKGROUND OF THE INVENTION

The invention relates to apparatus or equipment which restrains a swimmer at a particular point in a swimming tank for the training of swimmers of any proficiency level and/or facilitating physical therapy.

Numerous prior art swimming tank, side mounted restraining devices for training swimmers have been developed with the objective of allowing the swimmer to exercise freely while confining him to a middle area of the swimming tank. Such a device is advantageous in training novice swimmers in that their performance may be monitored by an instructor in a stationary situation at tankside, obviating the necessity for constant pursuit on the deck in order that the instructor maintain his view of, and communications with, the swimmer. Advanced swimmers may utilize the device for strengthening the body muscles employed in competitive swimming and for facilitating technique training where the advanced swimmer may concentrate on his performance without concern for repeated turns and possible obstructions.

For example, the swimming apparatus described in U.S. Pat. No. 3,512,416, issued May 19, 1970 to George Hohwart, constitutes one prior art design wherein a rigid oversize waist band with relatively rotatable inner and outer members fits around the waist of the swimmer to support him while using the device. While effective, such suspension designs have been shown to create an artificial support environment for the swimmer which is not advantageous for advanced training purposes. Additionally, suspension designs are generally bulky and cumbersome, and when in position at poolside they often create a formidable obstacle to others in and about the swimming pool area. It is also important that such apparatus not be difficult to move out of position when not being used.

Other aquatic training devices disclosed in the prior art include that set forth in U.S. Pat. No. 3,861,675, issued Jan. 21, 1975 to Robert Thornes Hopper. This device overcomes the artificial support aspect for the swimmer and provides for the variable loading of counterweights on the device through a pulley system to vary the restraining force which the swimmer must overcome in training for competitive swimming events particularly. It may be seen that such prior art devices are effective training mechanisms, but do require space alongside the pool and generally some poolside modification. Neither aspect facilitates versatility in use.

It would be an advantage therefore to provide lightweight portability in a device which would not require modification of the pool or pool deck. The apparatus of the present invention provides such a structure by incorporating a pivotal support frame which is secured by the force of the swimmer without modification of the pool wall or deck. Moreover, the present application improves upon and simplifies prior art belt constructions for securing the position of the belt about the waist of the swimmer and avoiding discomfort during use.

SUMMARY OF THE INVENTION

The present invention relates to a swimming aid support frame for upstanding unmodified attachment to a swimming tank side wall. More particularly, the support frame of the present invention includes at least one upstanding support arm having a lower side wall engaging element and means for pivotal securement to existing poolside structure. In another aspect, the present invention includes an upper lateral restraint means which pivotally couples with a rope junction receptacle of a conventional pool. Optionally, the lateral restraint means may couple to the swimming tank side wall lip or outside edge of the decking. The various junctions of the support frame may be either detachable or pivotally folded facilitating the additional advantage of compact portability to the invention. Thus the invention need not be permanently attached or anchored to the swimming tank and it does not create a poolside obstacle for others in the pool area.

In another aspect, the invention includes a flexible tether which is demountably attached to the vertex or highest point of the upstanding support arm or arms, providing the advantage of enchanced swimmer maneuverability through maximum tether clearance, as well as shock dampening in the restraing means through tether elasticity and/or a suitable dampening unit attached thereto.

In yet another aspect, the flexible tether is connected to a detachable swimming harness which is designed to equally distribute the restraining load about the waist the swimmer. A triangular extension at the apex of the harness is connected to the flexible tether to facilitate maximum utilization.

Additional advantages obtained by the proposed design include imparting a natural swimming environment for the swimmer without artificial support therefor. However, flotation devices may be used in conjunction with the invention for beginning swimmers. The device may easily be employed in a relatively small swimming tank without limiting the swimmer's choice of strokes or duration of training since the need for repeated directional changes is obviated in the stationary training situation.

BRIEF DESCRIPTION OF THE DRAWINGS

For a more complete understanding of the present invention reference may now be had to the following description taken in conjunction with the accompanying drawings in which.

DETAILED DESCRIPTION OF THE DRAWINGS

Figure 1:
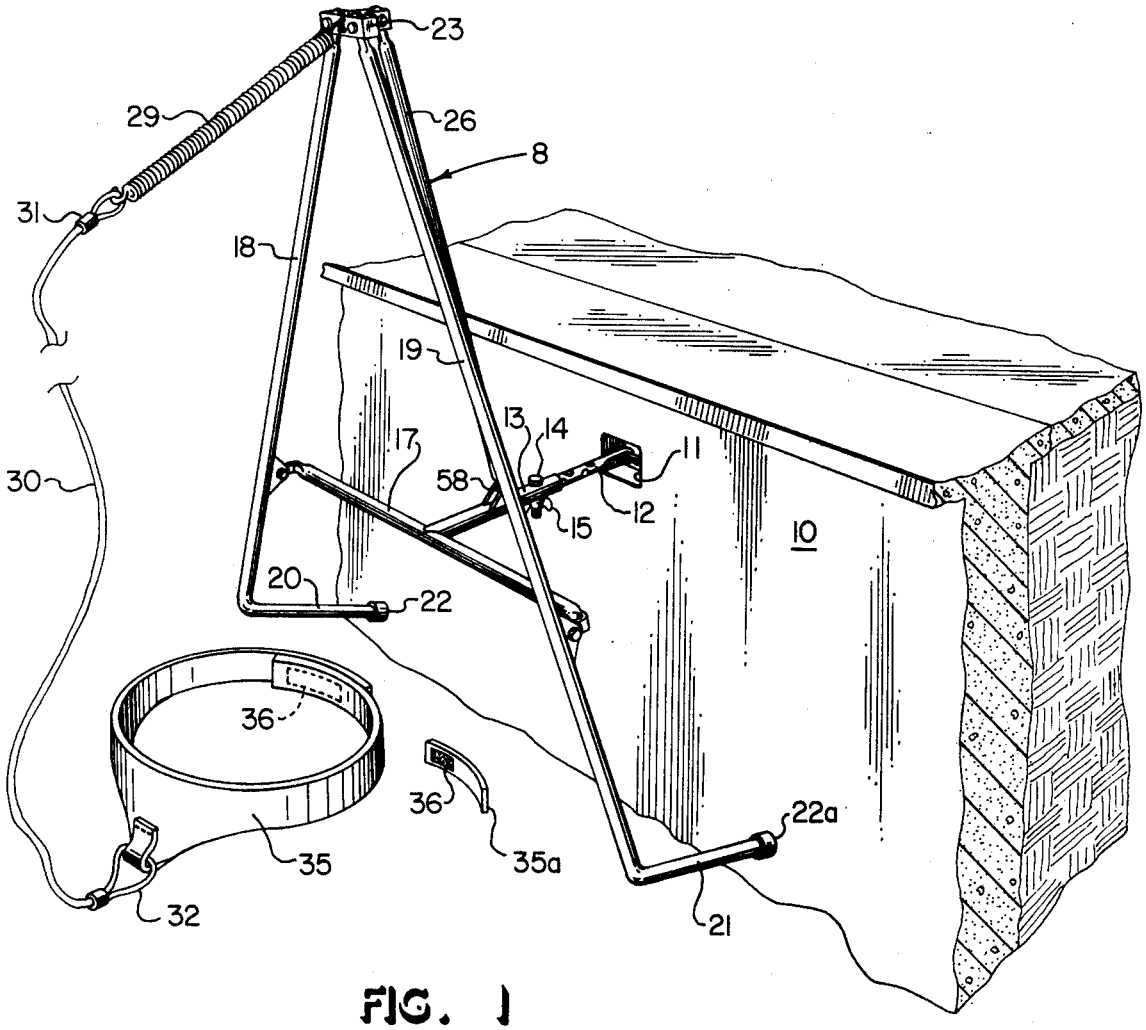
FIG. 1 is a view in persepective of one preferred embodiment of the portable swimmer training apparatus constructed in accordance with the principles of the present invention.

Referring first to FIG. 1, there is shown a fragmentary portion of a swimming tank side wall 10 of conventional design with a support frame 8 supported therefrom by a rope junction receptacle 11 recessed in the side wall. The rope receptacle is a standard fixture on most private and public pools of conventional design. Detachably coupled to the rope junction receptacle 11 is a coupling rod 12 of a lateral restraint member 13, which coupling rod 12 is slidably received within the lateral restraint member 13. A plurality of holes paired in 90 degree opposition are formed on the coupling rod 12 in two arrays, such that the holes of one array are horizontally opposed on the surface of the coupling rod 12 while the holes of a secondary, staggered array are vertically opposed at 90 degrees on said surface. The opposingly paired holes in each array are spaced in complimentary increments which permit successive registration of said holes in respect to a pair of vertically opposed holes in the lateral restraint member 13. Upon aligning a selected pair of coupling rod holes with a pair of lateral restraint member holes, a locking member such as bolt 14 may be inserted therebetween and affixed with a wing nut 15 or the like.

Figure 3:
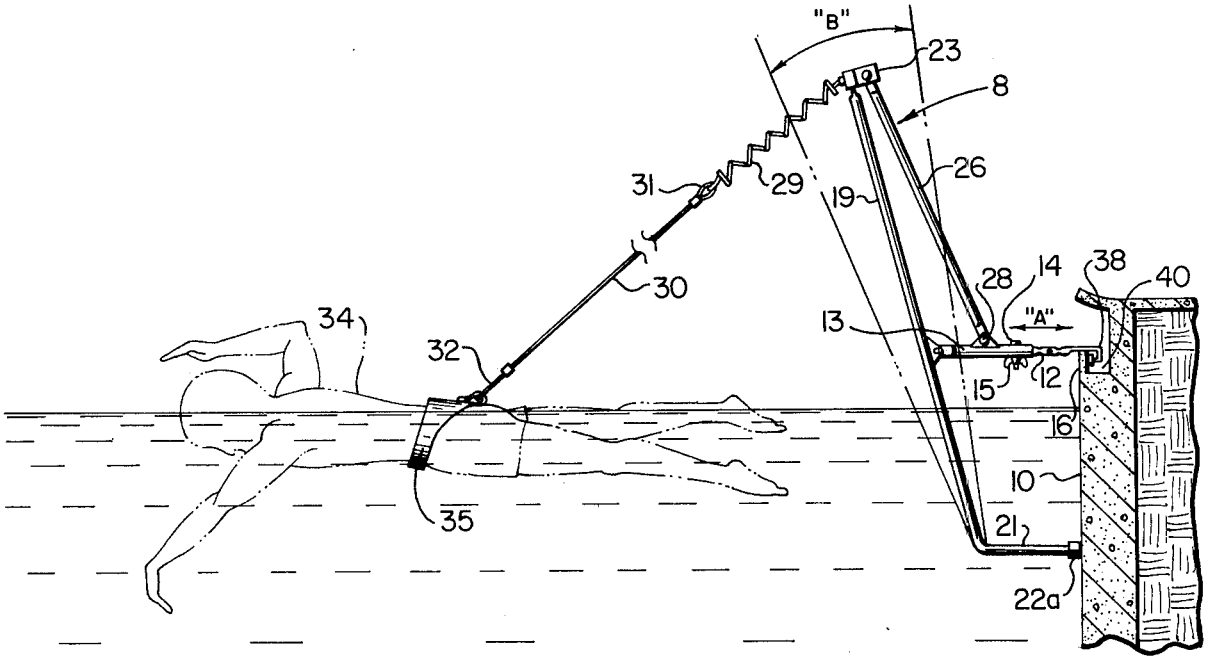
FIG. 3 is a side elevational view of the silhouette of a swimmer with an alternative embodiment of the portable swimmer training apparatus constructed within the principles of the present invention.

Referring now to FIG. 3, it may be seen that by selecting appropriate paired holes on the coupling rod 12 an operator may increase or decrease the length of the composite lateral restraint member 12 and 13, which movement is indicated by the arrow "A". Such an adjustment will vary the heighth of the support frame 8 as well as the angle of said frame in relation to the swimming tank side wall 10, as indicated by the arrow "B". A secondary array of 90 degree opposingly paired holes on the coupler rod 12 (shown in FIG. 1), is provided in order that the coupler rod 12 may be rotated 90 degrees to accommodate swimming tank side wall projections and rope junction receptacles which are so disposed. (See FIG. 5)

Figure 4:
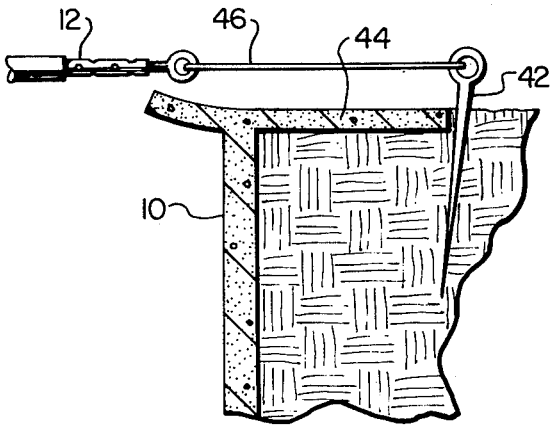
FIG. 4 is a side elevational view of another embodiment of the lateral restraint member of the support frame mounted on and detachably fastened to a support stay secured at the outer edge of the swimming tank deck.
Figure 5:
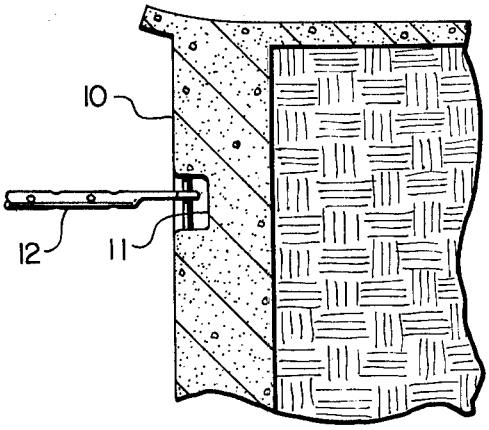
FIG. 5 is a side elevational view of the lateral restraint member shown in FIG. 1, here demonstrating an alternate means of detachably coupling said restraint member to the rope junction receptacle or the like incorporating a vertical connecting bar.

Referring now to FIGS. 3, 4 and 5 in combination, it may be seen that the present invention permits attachment of the frame 8 to a wide variety of pool side configurations. The coupling rod 12 is thus shown with modified attachment arms for comprising the lateral restraint means hereof. FIG. 3 shows a pool side wall "lip" adaptation of the coupling rod 12. In this embodiment, the coupling rod 12 is designed with a terminus comprising a U-shaped gripping member 38 which may be hooked over a drainage trough 40 of a pool to accommodate a side wall lip 16 of conventional thickness. FIG. 4 is next illustrative of "staking means" for providing lateral restraint in the absence of a lip 16 or rope junction receptacle 11. A stake 42 is thus shown secured into the area beyond the deck 44 via a tether 46. It may be seen that such staking is a suggested embodiment and any suitable securement means for laterally restraining the coupling rod 12 would permit utilization of the frame 8. For example, a suitably strong tether 46 could be secured to a tree or fence for private pool use. Finally, in FIG. 5 it may be seen that any vertical or horizontal shaft or rod could be used with the coupling rod 12 of the preferred embodiment.

Referring once again to FIG. 1, it may be seen that in the preferred embodiment of the invention the lateral restraint member 13 is securely affixed to the midpoint of the cross-member 17, which crossmember is connected at either end to a pair of upstanding support arms 18 and 19. The cross member 17 is detachably and pivotally connected to said support arms 18 and 19 in such a manner as to allow the support arms to incline or decline in relation to the crossmember 17 so that the support frame heighth and angle adjustment indicated at arrows "B" in FIG. 3 may be optimally effectuated.

Still referring to FIG. 1, it may be seen that the support arms 18 and 19 are designed in paired angulation comprising an "A" frame type constuction with lower side wall engaging elements 20 and 21 which are preferably coated or capped at their termini 22 and **22*a* with an energy absorbing material such as rubber. Such energy absorbing high friction caps prevent excessive abrasion to the side wall surface 10 and enhance the stability of the support structure by reducing slipping. The design also permits enhanced stability by providing a wide base substantially along or beneath the plane of the swimmer. In this manner, only a single lateral restraint member is necessary to provide stability of the magnitude generally manifested in much larger structures. The present invention, however, provides said stabilization substantially within the confines of the pool and not about the deck 10** so as to interfere with the pool side space.

Figure 2:
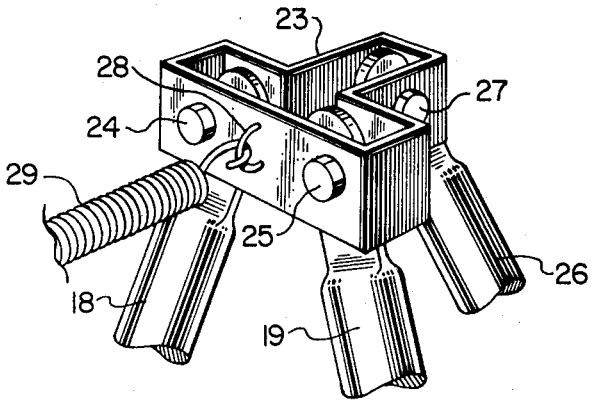
FIG. 2 is an enlarged, fragmentary view of the apparatus of FIG. 1, showing in more detail one embodiment of the collapsible support frame vertex with the flexible tether coupled thereto.

Referring together now to FIGS. 1 and 2 it may be seen that at the alternate end of each support arm 18 and 19 said arms are pivotally attached to the vertex bracket 23 by connecting pins 24 and 25. The pivotal attachment of the support arms 18 and 19 permits the collapse of the support structure 8 for ease in transportation. Disposed posteriously to the pivotal attachment points 24 and 25 of the support arms and 18 and 19 on the vertex bracket 23, and positioned equidistant between said support arm attachment points 24 and 25, lies a pivotal attachment point of the vertical restraint member 26 pivotally attached by the connecting pin 27. This particular "collapse" configuration is of course one of many collapse designs and is shown herein for purposes of illustration.

The vertical restraint member 26 is shown most clearly in FIG. 3. The member 26 pivots on an axis which extends perpendicularly from the pivotal axis of the support arms 18 and 19. Such pivotal movement of the vertical restraint member 26 allows said restraint member 26 to be collapsably folded towards the side arms 18 and 19 for flat packing.

Referring now to FIGS. 1 and 3 in combination, it may be seen that the vertical restraint member 26 is pivotally and detachably connected to the lateral restraint member 13 by a removable connecting pin 58 or the like. The pin 58 is secured at a point between the cross member 17 connection and the coupler rod 12 connection to comprise the angular structure herein illustrated. Said detachment capability accommodates the flat folding of the vertical restraint member 26 for portability as discussed hereinabove.

Referring now to FIGS. 2 and 3, there is shown the connection of the swimmer restraining member comprising a tether 30 and tether spring 29. The tether spring 29 is utilized in the preferred embodiment for shock absorbtion purposes in order to provide smooth and consistent restraint for the swimmer in the end of the tether 30. It may also be seen that a suitable shock dampener system may be utilized. The lower terminus of the tether spring 29 is connected to the tether, or line 30 securing a spring hook to a line loop 31. At the opposite terminus of the line 30, a line loop 32 is connected to a harness 35.

Referring once again to FIGS. 1 and 3, the swim harness 35 may be constructed of a heavy-duty canvas-type material. The harness 39 is preferably designed with a triangular extension at the midpoint between the two ends of the harness so as to efficiently and comfortably distribute the bearing load being borne by the swimmer 34 uniformly about his waist area. In one constructional embodiment, the apex of the triangular extension is folded over and permanently bonded to itself so as to secure therein the tether loop 32 as described above. The harness 35 is fastened about the waist of the swimmer 34 and is preferably secured to its opposite end by a Velcroe seal 36 or another similar material binder which is readily releasable and functions properly when submerged in water. For extending the size range of the harness 35, an extension section 35*a*, also of Velcroe, or the like, may be added.

In operation the frame 8 is connected to the pool tank wall as shown. The pull of the swimmer, as shown in FIG. 1 causes a pivotal movement which places the lateral restraint member 13 in tension which places the lateral restraint member 13 in tension and the lower wall engaging portions 20 and 21 in compression. The "A" frame construction of frame 8 allows lateral stability for swimming side to side while ample clearance is offered beneath the tether 30 for kicking action. The frame 8 is preferably formed of rigid tubing and the feature of collapsbility permits the frame to be easily transported. Finally, it is of much advantage to permit the frame 8 to be disposed within the pool area rather than on the adjacent deck. Except in the case of a tether 46, as shown in FIG. 4, the associated deck area is unobstructed.

The foregoing embodiment is considered to have been shown and described in a preferred embodiment of this invention. It will be obvious that various changes and modifications may be made without departing from the spirit and scope of the invention as defined in the following claims.

What is claimed:

1. Apparatus for attachment to the inside wall of a swimming tank and the upstanding support therefrom without alteration thereto for facilitating exercise therein by a swimmer, said apparatus being substantially disposable within the walls of said swimming tank and comprising:

a detachable belt for positioning about the waist of a swimmer;

a support frame for upstanding attachment to said swimming tank side wall;

a tether connecting said belt and said support frame for restraint of the swimmer;

said support frame including at least one upstanding support arm having a lower side wall engaging element and an upper lateral restraint means disposed beneath said tether, said frame being substantially confined within and pivotally braced against the side wall of the swimming tank by said lateral restraint means and said lower side wall engaging element for securement of the swimmer without alteration of the swimming tank;

said support frame being comprised of a pair of upstanding support arms configured in an A-frame configuration and structurally connected in a vertex at the top thereof with said A-frame configuration of said support frame including a cross arm extending between said support arms and wherein said lateral restraint means is structurally connected to said cross arm and includes a horizontal strut secured at one end to said cross arm and adapted at the other end for engagement to a securement means for support of said apparatus substantially within said swimming tank; and said A-frame configuration including a vertical support arm disposed between said upstanding arms and the side wall of said swimming tank, said vertical support arm being connected at the top to said vertex of said upstanding arms and at the bottom thereof to said horizontal strut.

* * * * *